US012215493B1

(12) United States Patent
Lawrence

(10) Patent No.: US 12,215,493 B1
(45) Date of Patent: Feb. 4, 2025

(54) DRAIN DEVICE

(71) Applicant: Barry G. Lawrence, Trinity, NC (US)

(72) Inventor: Barry G. Lawrence, Trinity, NC (US)

( * ) Notice: Subject to any disclaimer, the term of this patent is extended or adjusted under 35 U.S.C. 154(b) by 480 days.

(21) Appl. No.: 17/657,964

(22) Filed: Apr. 5, 2022

(51) Int. Cl.
*E03F 5/06* (2006.01)
*E03F 1/00* (2006.01)

(52) U.S. Cl.
CPC ..... *E03F 5/06* (2013.01); *E03F 1/002* (2013.01)

(58) Field of Classification Search
None
See application file for complete search history.

(56) References Cited

U.S. PATENT DOCUMENTS 319,112 A * 6/1885 Nevius ..... E01C 11/223 138/108
545,915 A * 9/1895 Russell ..... B67C 11/02 248/94
831,429 A * 9/1906 Harrington ..... F16L 41/02 126/82
899,568 A * 9/1908 Shepard ..... B01D 29/111 210/163
1,457,637 A * 6/1923 Sievers ..... E02B 11/005 285/298
2,436,593 A * 2/1948 Moselowitz ..... E01C 11/221 D25/164
2,672,205 A * 3/1954 McDonald ..... E03C 1/22 210/163
2,938,437 A * 5/1960 Daley ..... E03F 5/046 285/125.1
2,971,650 A * 2/1961 Miranda ..... E04D 13/08 210/451
3,420,552 A * 1/1969 Mork ..... E03F 5/0408 4/288
3,714,786 A * 2/1973 Evans ..... E02B 11/005 405/49
3,815,213 A * 6/1974 Evans ..... E01C 11/227 29/446
3,882,743 A * 5/1975 Evans ..... E02B 11/005 83/156
3,898,778 A * 8/1975 Erickson ..... E04G 11/04 264/32
4,014,053 A * 3/1977 Jones ..... E03D 11/16 4/252.5
4,183,484 A * 1/1980 Mathews ..... H02G 9/06 403/287
4,273,466 A * 6/1981 Trahan, Sr. ..... E03F 5/0401 210/163

(Continued)

FOREIGN PATENT DOCUMENTS

KR 2002-0038155 5/2002

*Primary Examiner* — Robert J Popovics
(74) *Attorney, Agent, or Firm* — Tuggle Duggins P.A.; Blake P. Hurt

(57) ABSTRACT

A drain including a stand and a conduit is disclosed. The stand is formed from a face and at least one side, the face including a first conduit with an upper end further forming an inlet and a lower end forming an outlet. A drain cover with a number of slats may be attached to the stand. The stand is positioned over an opening through a portion of one side of a second conduit so that the lower end of the first conduit is insertable into the opening. The stand and drain cover are fastened together by a one or more fastener(s) through different one or more hole(s) of the stand and one or more hole(s) of the drain cover.

19 Claims, 8 Drawing Sheets

(56) References Cited

U.S. PATENT DOCUMENTS 4,365,911 A * 12/1982 Rossberg ..... E01C 11/227 404/2
4,490,067 A * 12/1984 Dahowski ..... E01C 11/227 52/169.5
4,640,643 A * 2/1987 Williams ..... E01C 11/227 405/118
4,787,773 A * 11/1988 Kehler ..... E01C 11/227 405/36
4,815,888 A * 3/1989 Stegmeier ..... E04F 15/14 404/4
4,838,727 A * 6/1989 Capuano ..... E01C 11/227 404/2
4,844,655 A * 7/1989 Aleshire ..... E03F 3/046 52/741.11
5,181,793 A * 1/1993 Dekel ..... E01C 11/227 404/47
5,269,354 A * 12/1993 Koberg ..... F16N 33/00 141/332
5,360,284 A * 11/1994 Allard ..... E03F 5/0401 52/21
5,372,457 A * 12/1994 Rante ..... E02B 11/005 52/155
5,380,121 A * 1/1995 Schluter ..... E01C 11/227 210/164
5,529,436 A * 6/1996 Meyers ..... E03F 3/046 405/118
5,540,264 A * 7/1996 Harp ..... B67D 1/0842 141/366
5,564,857 A * 10/1996 Schluter ..... E02B 11/005 405/36
5,636,670 A * 6/1997 Baker ..... F16N 31/004 141/98
5,647,692 A * 7/1997 Gunter ..... E01C 11/227 473/278
5,653,631 A * 8/1997 Andersen ..... F24F 13/0209 454/339
5,785,457 A * 7/1998 Thompson ..... F16L 1/201 405/172
5,908,266 A * 6/1999 Miller ..... E01C 11/227 405/36
6,000,881 A * 12/1999 Becker ..... E03F 3/046 405/52
6,035,908 A * 3/2000 Hoffmann ..... B65B 39/00 141/331
6,109,824 A * 8/2000 Annes ..... E03F 5/0401 404/26
6,113,311 A * 9/2000 Becker ..... E01C 11/227 405/121
6,234,711 B1 * 5/2001 Beaman ..... E01C 11/223 249/8
6,280,117 B1 * 8/2001 Obermeyer ..... E02B 11/00 405/36
6,385,913 B1 * 5/2002 Ahn ..... E02D 29/12 404/26
6,405,765 B1 * 6/2002 Handrick ..... F16N 31/002 141/331
6,663,317 B1 * 12/2003 Williams ..... E03F 3/046 405/48
6,746,179 B1 * 6/2004 Kerkhoff ..... A01K 1/0103 405/41
7,008,137 B2 * 3/2006 Muller ..... E01C 11/225 405/38
7,108,783 B2 * 9/2006 Glazik ..... E03F 5/0404 210/170.03
7,264,418 B1 * 9/2007 Houck ..... E03F 3/046 405/47
7,413,372 B2 * 8/2008 Meyers ..... E03F 3/046 404/2
D582,527 S * 12/2008 Wang ..... D23/267
7,866,911 B2 * 1/2011 Saadi ..... E03F 3/046 404/2
8,708,603 B2 * 4/2014 Kerkhoff ..... E03F 3/046 405/184.4
8,734,051 B2 * 5/2014 Kerkhoff ..... E03C 1/12 405/184.4
8,857,481 B2 * 10/2014 Aviles ..... E03F 5/041 141/340
8,959,858 B1 * 2/2015 Francisco ..... E03F 5/04 52/302.3
9,127,446 B2 * 9/2015 Schlueter ..... E03F 5/04
D749,707 S * 2/2016 Kuang ..... D23/263
9,567,738 B2 * 2/2017 Schlueter ..... E03F 5/04
9,611,634 B2 * 4/2017 Erlebach ..... E03F 5/0408
9,739,044 B1 * 8/2017 Files, Jr. ..... E03F 3/046
10,047,512 B2 * 8/2018 Chromey ..... E03F 3/046
10,544,576 B2 * 1/2020 Ismert ..... E03F 5/0401
10,738,494 B1 * 8/2020 Krombein ..... E04H 4/1218
10,774,517 B2 * 9/2020 Chromey ..... E03F 3/046
10,798,886 B2 * 10/2020 Russell ..... E03B 1/04
11,002,408 B2 * 5/2021 Plourde ..... F16N 33/00
11,021,864 B1 * 6/2021 Mjelde ..... E04H 4/06
11,555,279 B2 * 1/2023 Cuellar ..... E01F 5/00
11,613,883 B2 * 3/2023 Bernoti ..... E03F 5/0408 210/163
11,808,020 B2 * 11/2023 Robillard ..... E03C 1/26
11,933,034 B2 * 3/2024 Meincke ..... F16L 9/22
11,982,097 B2 * 5/2024 Powers, II ..... E03F 5/04
12,012,742 B2 * 6/2024 Henry ..... B01D 29/35
12,018,489 B2 * 6/2024 Majocka ..... E04D 13/0409
2006/0048469 A1 * 3/2006 MacLean ..... E03F 5/0402 52/220.3
2006/0239773 A1 * 10/2006 Meyers ..... E01C 11/227 404/2
2007/0017578 A1 * 1/2007 Dallmer ..... E03F 5/0408 137/362
2007/0034577 A1 * 2/2007 Bayard ..... E03F 5/06 210/163
2007/0099782 A1 * 5/2007 Saadi ..... E03F 3/046 493/2
2010/0176041 A1 * 7/2010 Schlueter ..... E03F 5/0407 210/163
2011/0023978 A1 * 2/2011 Keizers ..... E03F 5/0407 137/362
2011/0094622 A1 * 4/2011 McLoy ..... B67C 11/00 141/340
2011/0204529 A1 * 8/2011 Kerkhoff ..... F16L 3/00 264/34
2012/0288330 A1 * 11/2012 Altinier ..... E01C 11/227 405/43
2013/0174921 A1 * 7/2013 Schluter ..... E03F 5/0406 137/362
2014/0060668 A1 * 3/2014 Kerkhoff ..... F16L 3/00 137/356
2015/0040500 A1 * 2/2015 Francisco ..... E04H 4/1227 52/302.3
2016/0130794 A1 * 5/2016 Erlebach ..... E03F 5/0408 4/613
2016/0194861 A1 * 7/2016 Nivelles ..... E03F 5/0408 285/42
2016/0265203 A1 * 9/2016 Knapp ..... E03F 5/0408
2019/0211540 A1 * 7/2019 Bernoti ..... E03F 5/0408
2021/0222418 A1 * 7/2021 Henry ..... B01D 29/35
2022/0120073 A1 * 4/2022 Meincke ..... E01C 11/227
2022/0127835 A1 * 4/2022 Meincke ..... E03F 3/04
2024/0251765 A1 * 8/2024 Schmidt ..... C02F 1/001

* cited by examiner

DRAIN DEVICE

FIELD OF THE INVENTION

The present disclosure relates generally to one or more devices, systems, and methods for water and urban planning, and more specifically pertains to a device, the system, and method of capturing surface runoff in urban, suburban, and rural areas with a device that can engage an exterior surface of a fluid conduit.

DESCRIPTION OF THE PRIOR ART AND OBJECTIVES OF THE INVENTION

As used herein, the term "runoff" is used to refer to surface runoff of one or more fluids such as rainwater, landscape irrigation, or car washing created by urbanization. Permeable surfaces such as uncompacted soil, permeable sidewalks, gravel, turf, and planting beds allow runoff at the surface to seep into the ground during runoff events and reduce the overall volume of water traveling across the surface at a given time. Impervious and permeable surfaces that have already been water-logged prevent water from seeping into the ground, thereby allowing runoff to accumulate on the surface. Accumulated runoff follows the watershed into channels and streams.

Surface runoff presents numerous challenges and environmental concerns. For example, runoff may pick up loose sediment as it travels, eroding soil. Erosion is a major concern for homeowners in urban, suburban, and rural settings. Erosion can cause houses to move, produce instability in foundations, and degradation in the quality of soil. Further, runoff can pick up pollutants like fertilizers, pesticides, herbicides, and other particulates and cause algae blooms in local bodies of water and pollute streams. Accordingly, there is a need to quickly redirect and/or remove surface water before runoff can accumulate and cause damage.

Numerous methods of capturing runoff have been developed to combat erosion and pollution but have demonstrated limited success. In KR20020038155, a Korean patent disclosed a drain system where the runoff enters an inlet through a grate. The width of the inlet pipe is reduced, funneling a relatively short distance from the beginning of the inlet pipe. The inlet pipe then intersects with an underground pipe via a "Y" or "T" connection. In U.S. Pat. No. 10,798,886, a system similar to the Korean disclosure further teaches an organic substrate in the funnel section. In US Pub. No. 2010/0176041, a drain cover is shown that can prevent debris from entering an underground pipe. Each of these disclosures are incorporated herein in their respective entireties.

However, a drainage system such as KR20020038155 is not always an economically feasible option for the average consumer especially if there is already an existing underground conduit for transporting captured runoff. Therefore, there is a need for an economical and mechanically simple drain that can be installed onto existing underground conduits that would facilitate the removal of surface runoff in urban, suburban, and rural areas.

It is an objective of the present disclosure to provide a relatively inexpensive structure for adding an additional drain inlet for existing underground conduits for transporting surface runoff in urban, suburban, and rural areas.

It is another objective of the present disclosure to provide a structure that can effectively capture surface runoff and reduce the overall volume of surface runoff in an area.

It is a further objective of the present disclosure to provide a structure that can effectively capture surface runoff while preventing debris such as roots, leaves, and other large matter from entering an existing conduit for transport of surface runoff.

It is yet another objective of the present disclosure to provide a structure that captures surface runoff through an inlet and exits through an outlet that is sized to be smaller than the inlet.

It is still a further objective of the present disclosure to provide a structure that is shaped to fit around a portion of a conduit for transporting surface runoff.

It is still another objective of the present disclosure to provide a structure which is prevented from displacing in any direction by being weighed down by a ballast.

It is yet another objective of the present disclosure to provide a structure that is partially assembled by inserting stakes or a different fastener into holes defined by the structure.

It is still another objective of the present disclosure to provide a structure that is inserted into an already drilled hole in the portion of a conduit for transporting surface run off.

It is still a further objective of the present disclosure to provide a structure that can be installed in urban, suburban, and rural locations.

Various other objectives and advantages of the present disclosure will become apparent to those skilled in the art as a more detailed description is set forth below.

SUMMARY OF THE INVENTION

The aforesaid and other objectives are realized in the preferred embodiment by providing a drain that is comprised of a stand and a drain cover. The stand is formed from a face and two sides. The face includes a first conduit. The first conduit defines two ends, an upper end, and a lower end. The drain cover and the stand each define at least one hole to receive a stake. The stake is inserted through the hole of the drain cover and the hole of the stand and fastens the drain cover to the stand. The drain cover further defines a plurality of slats that prevent debris flowing with surface runoff from passing through the first conduit. The two sides of the stand are in opposing relation to one another and each define a first opening. The respective first openings are sized and shaped to accept a portion of a second conduit. Each first opening is located at an edge of one of the sides in opposing relation to an edge shared by the face of the stand and the corresponding side. The drain is positioned over an opening defined through the second conduit so that the lower end of the first conduit is aligned with the opening of the second conduit. The drain may include a ballast to prevent it from displacing in any direction from the second conduit.

DETAILED DESCRIPTION OF THE PREFERRED EMBODIMENT AND OPERATION OF THE INVENTION

Figure 1:
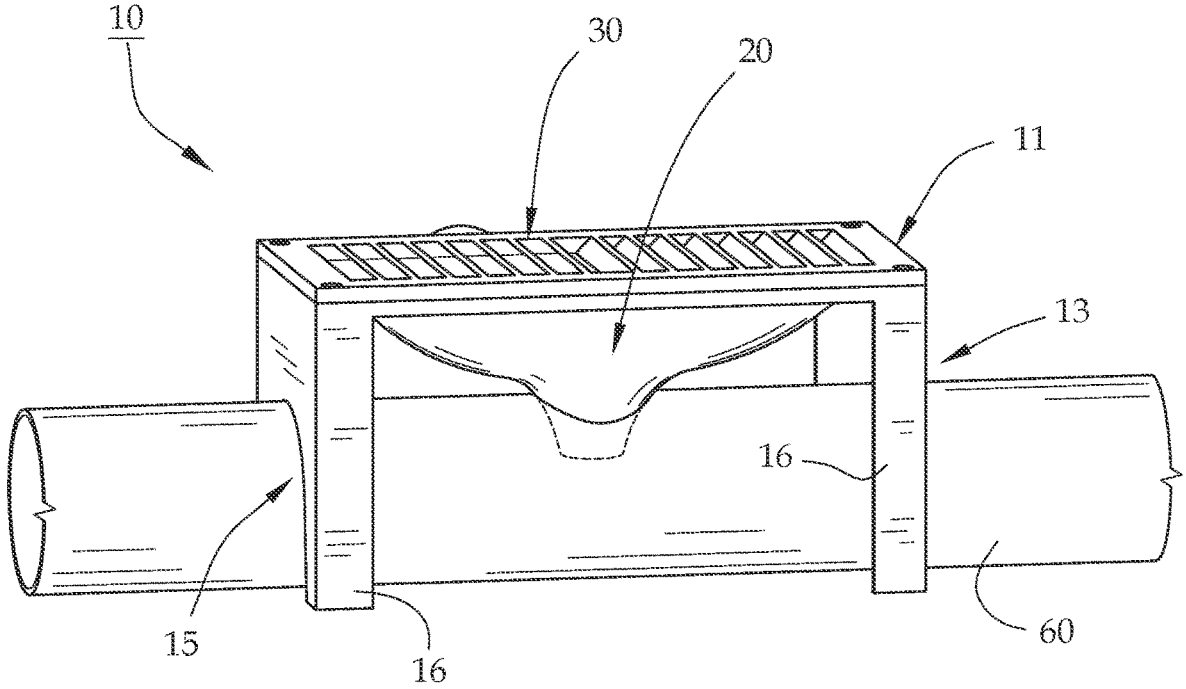
FIG. 1 illustrates a perspective view of an embodiment of the drain as affixed to a conventional underground pipe.

Various exemplary embodiments of the present disclosure are described below. Use of the term "exemplary" means illustrative or by way of example only, and any reference herein to "the disclosure" is not intended to restrict or limit the disclosure to exact features or step of any one or more of the exemplary embodiments disclosed in the present specification. References to "exemplary embodiment", "one embodiment", "an embodiment", "various embodiments", and the like may indicate that the embodiment(s) of the disclosure so described may include a particular feature, structure, or characteristic, but not every embodiment necessarily includes the particular feature, structure, or characteristic. Further, repeated use of the phrase "in one embodiment", "in an exemplary embodiment", or "in an alternative embodiment" do not necessarily refer to the same embodiment, although they may.

It is also noted that terms like "preferably", "commonly", and "typically" are not utilized herein to limit the scope of the disclosure or to imply that certain features are critical, essential, or even important to the structure or function of the disclosure. Rather, these terms are merely intended to highlight alternative or additional features that may or may not be utilized in a particular embodiment of the present disclosure.

The present disclosure is described more fully hereinafter with reference to the accompanying figures, in which one or more exemplary embodiments of the disclosure are shown. Like numbers used herein refer to like elements throughout. The disclosure may, however, be embodied in many different forms and should not be construed as limited to the embodiments set forth herein; rather, these embodiments are provided so that this disclosure will be operative, enabling, and complete. Accordingly, the particular arrangements disclosed are meant to be illustrative only and not limited as to the scope of the disclosure, and any and all equivalents thereof. Moreover, many embodiments such as adaptations, variations, modifications, and equivalent arrangements will be implicitly disclosed by the embodiments described herein and fall within the scope of the instant disclosure.

Although specific terms are employed herein, they are used in a generic and descriptive sense only and not for the purposes of limitation. Unless otherwise expressly defined herein, such terms are intended to be given their broad, ordinary, and customary meaning not inconsistent with that applicable in the relevant industry and without restriction to any specific embodiment hereinafter described. As used herein, the article "a" is intended to include one or more items. Where only one item is intended, the terms "one and only one", "single", or similar language is used. When used herein to join a list of items, the term "or" denotes at least one of the items but does not exclude a plurality of items of the list.

For exemplary methods or processes of the disclosure, the sequence and/or arrangement of steps described herein are illustrative and not restrictive. Accordingly, it should be understood that, although steps of various processes or methods may be shown and described as being in a sequence or temporal arrangement, the steps of any such processes or methods are not limited to being carried out in any particular sequence or arrangement, absent an indication otherwise. Indeed, the steps in such processes or methods generally may be carried out in various different sequences and arrangements while still falling within the scope of the present disclosure.

For a better understanding of the disclosure and its operation, turning now to the drawings, FIG. 1 illustrates the preferred embodiment for an improved drain 10. As used herein, the term "drain" is used to refer to a device that is ideally suited for being installable onto an existing conduit to create another inlet into said conduit that filters out debris like organic matter, particulates, and garbage. The existing conduit may be, for example, a substantially horizontal, underground pipe or a vertical pipe that is exposed to open air. The drain is insertable through an opening formed through a side, ideally the top side, of the existing conduit.

Referring to FIGS. 1-8, one or more embodiments of the preferred drain 10 are illustrated therein. The preferred embodiment of drain 10 comprises a stand 11 formed from a face 12 and at least one side 13. The face 12 defines a first conduit 20. The first conduit 20 is formed from an exterior surface 21 and an interior surface 22. The first conduit 20 further defines an upper end 23 and a lower end 25. The upper end 23 defines an inlet 24. The lower end 25 defines an outlet 26. The upper end 23 and lower end 25 are in fluid communication with each other.

The preferred drain 10 is configured such that the stand 11 can be positioned on a second conduit 60, which may be an existing or new drainage pipe, used to transport surface runoff, such that the lower end 25 of the first conduit 20 is insertable through an opening 61 (FIG. 5) formed in second conduit 60. When this setup of the first conduit 20 and stand 11 is realized, surface runoff (not shown) flows into the larger opening of inlet 24 of the first conduit 20 and exits through the smaller opening of outlet 26 of lower end 25 into second conduit 60. As would be understood, when joining drain 10 to second conduit 60, the opening 61 formed therein is sized proximate the outer diameter of the outlet 26 to provide for a frictional engagement to ensure fluid movement is contained within the conduits. As further understood the use of gaskets, o-rings, sealants, or the like, whether temporary or permanent may be utilized to further ensure the tightness of the seal, while also keeping dirt, debris, and the like from entering the second conduit 60.

Now referring to FIGS. 1, 2, 4, and 5, in one or more embodiments, the stand 11 includes legs 16 and in the preferred embodiment is comprised of the side 13 and at least one additional side 13, forming at least two sides 13. Two of said sides 13 are in opposing relation to one and other. The two sides 13 that are in opposing relation with one and other each define a first opening 15. The first openings 15 are sized and shaped to accept a portion of the second conduit. Each first opening 15 is located at an edge of the at least two sides 13 in opposing relation to an edge shared by the face 12 of the stand 11 and the corresponding side 13. In one or more embodiments, the sides 13 as described in this paragraph are defined by a circular shape.

The stand 11 is further comprised of a circular-side 13. The side 13 defines two first openings 15 in opposing relation to one and other. The first openings 15 are sized and shaped to accept a portion of the second conduit 60. Each first opening 15 is located at an edge of the side 13 in opposing relation to an edge shared by the face 12 of the stand 11 and the side 13. In one or more embodiments of drain 10, the upper end 23 of face 12 is sized to be greater than the lower end 25, and the inlet 24 is sized to be greater than the outlet 26. Surface runoff flows into the inlet 24 and flows out of the outlet 26, wherein the inlet 24 facilitates the capture of surface runoff which then converges to the narrower outlet 26.

Figure 5:
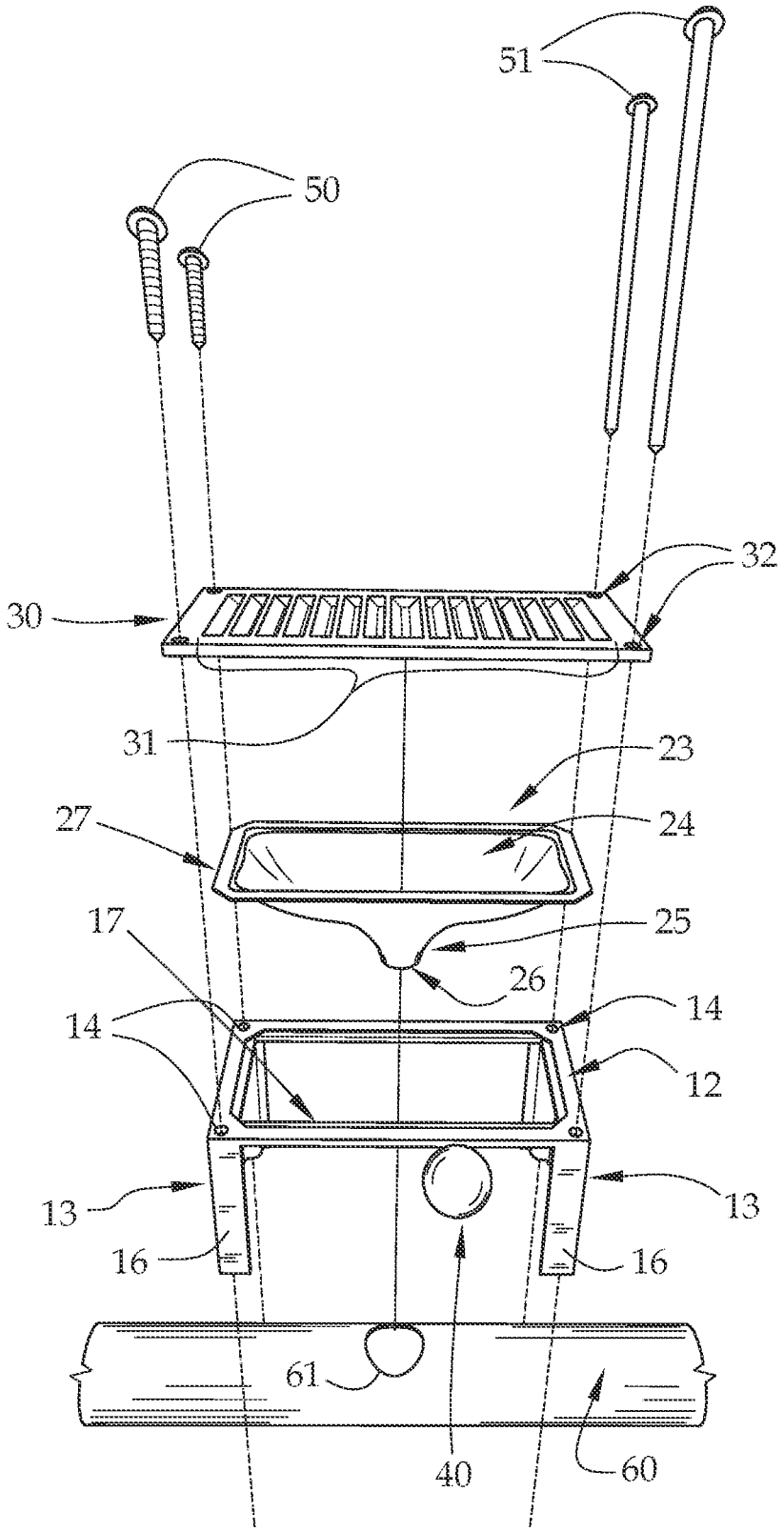
FIG. 5 illustrates an exploded view of an alternate drain as seen in FIG. 1.
Figure 6:
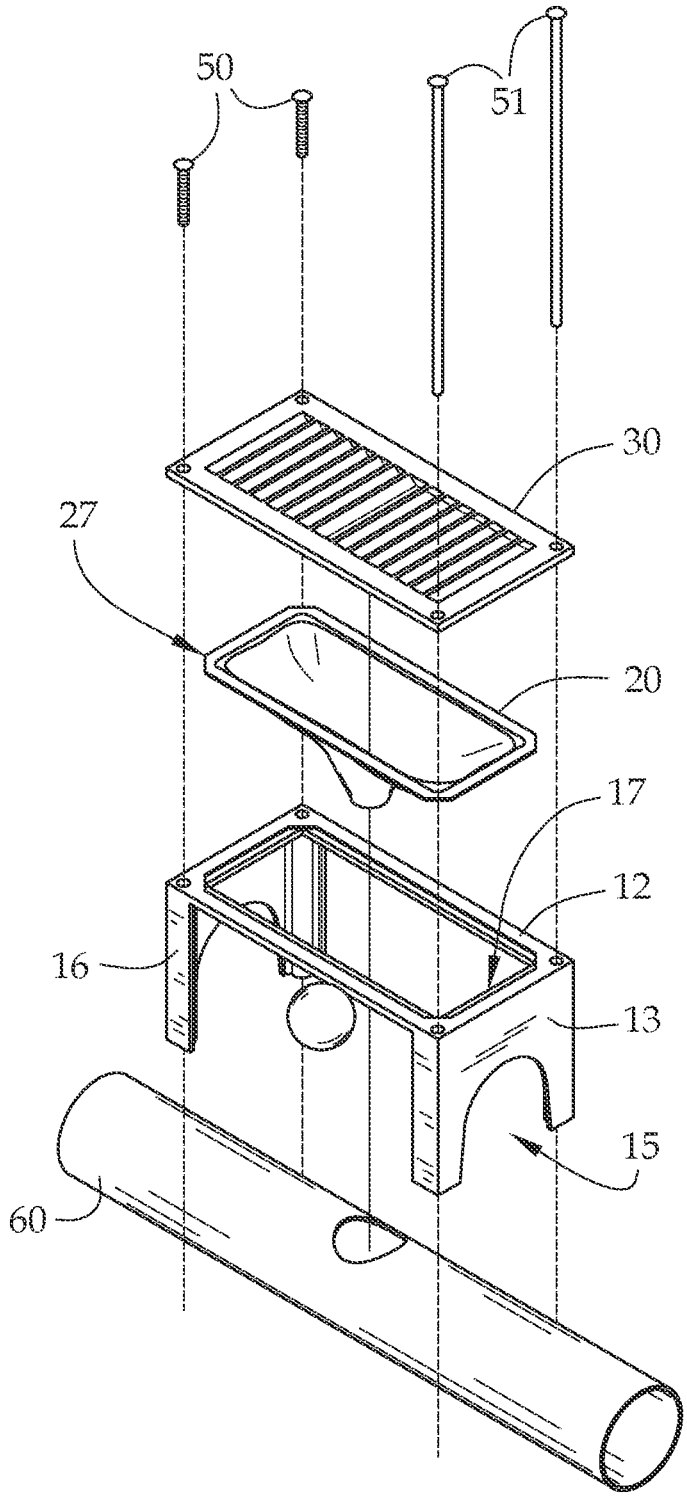
FIG. 6 illustrates a perspective exploded view of the drain seen in FIG. 5.
Figure 7:
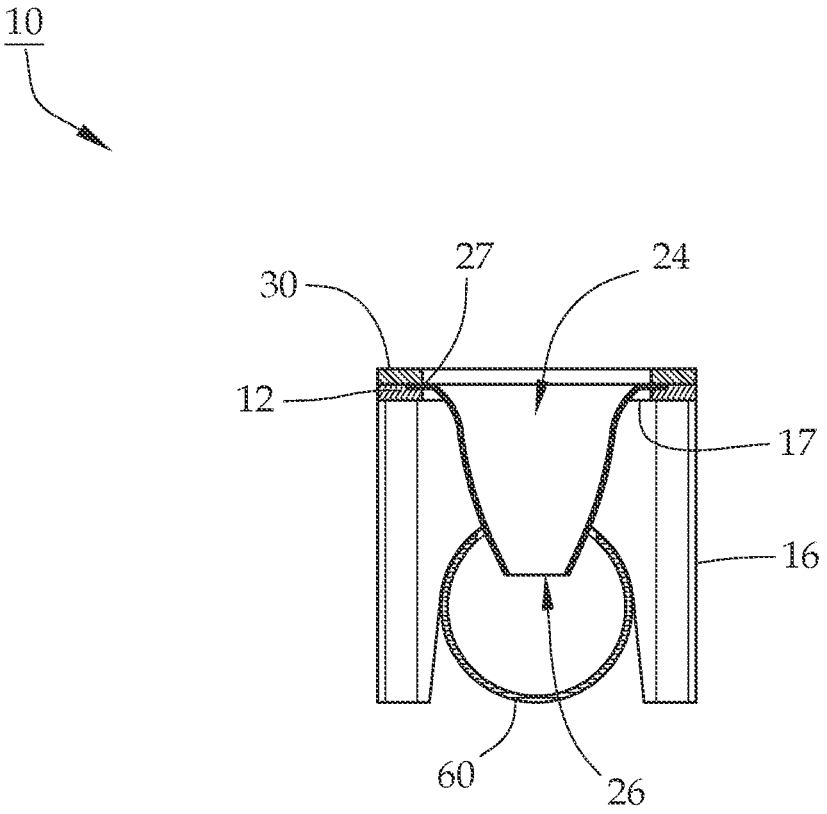
FIG. 7 illustrates a cross-sectional view of the drain seen in FIG. 4 along cut lines 7-7.

As shown at least in FIGS. 1 and 5, embodiments of drain 10 further include the inlet 24 and upper end 23 that may be rectangular in shape and the outlet 26 and lower end 25 which may be circular in shape. One or more embodiments of drain 10 may further comprise a drain cover 30. The drain cover 30 preferably defines a plurality of slats 31. The plurality of slats 31 may be arranged in series. The plurality of slats 31 ideally facilitate the filtering of surface runoff by preventing large debris (not shown) from entering the inlet 24 of the first conduit 20 such as, but not limited to, leaves, roots, garbage, and other matter. In the preferred embodiment, the drain cover 30 is sized and shaped to approximate the same dimensions as the face 12 of the stand 11, particularly (but not exclusively) as it relates to the diameters of the respective structures.

Preferred embodiments of drain 10 further comprise one or more stand holes 14 defined through the face 12 of the stand 11 and one or more drain cover holes 32 defined through the drain cover 30. In the most preferred embodiment, there are an equal number of the one or more stand holes 14 and one or more drain cover holes 32. In certain embodiments of stand 30, the one or more stand hole(s) 14 and one or more drain hole(s) 32 are sized and shaped to receive a fastener 50 (FIG. 5), such as (but not limited to) a screw, a bolt, or a stake, which is first inserted through different one or more drain cover holes 32 and then through the one or more stand holes 14. Tightening the fastener 50 frictionally attaches the drain cover 30 to the face 12 of the stand 11. As would be understood, if providing a stake, such as stake 51 (FIG. 6), it may be of a length long enough to penetrate the ground during placement adding further stability in the event a tremendous amount of surface runoff, such as water, is encountered to prevent the drain 10 from dislodging from the second conduit 60.

Figure 2:
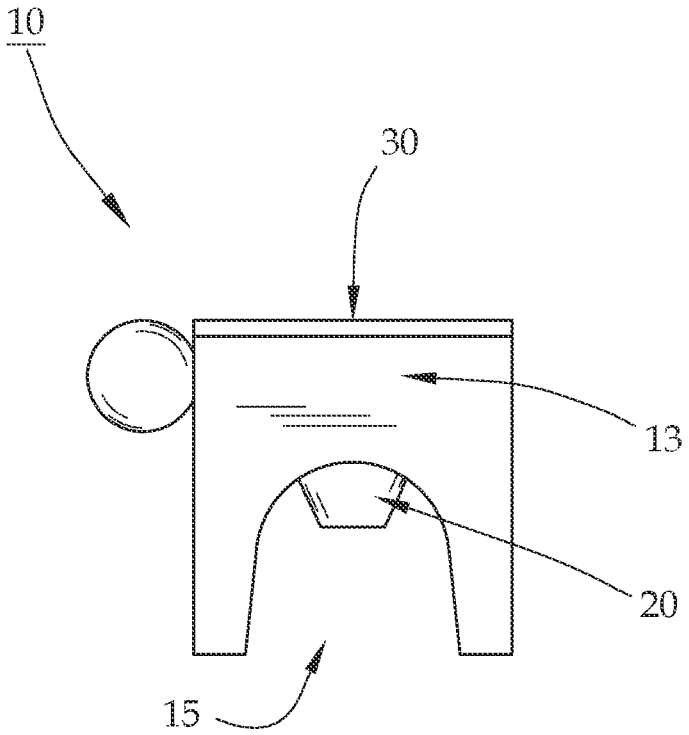
FIG. 2 illustrates an end view of the drain seen in FIG. 1 prior to attachment to the pipe.
Figure 3:
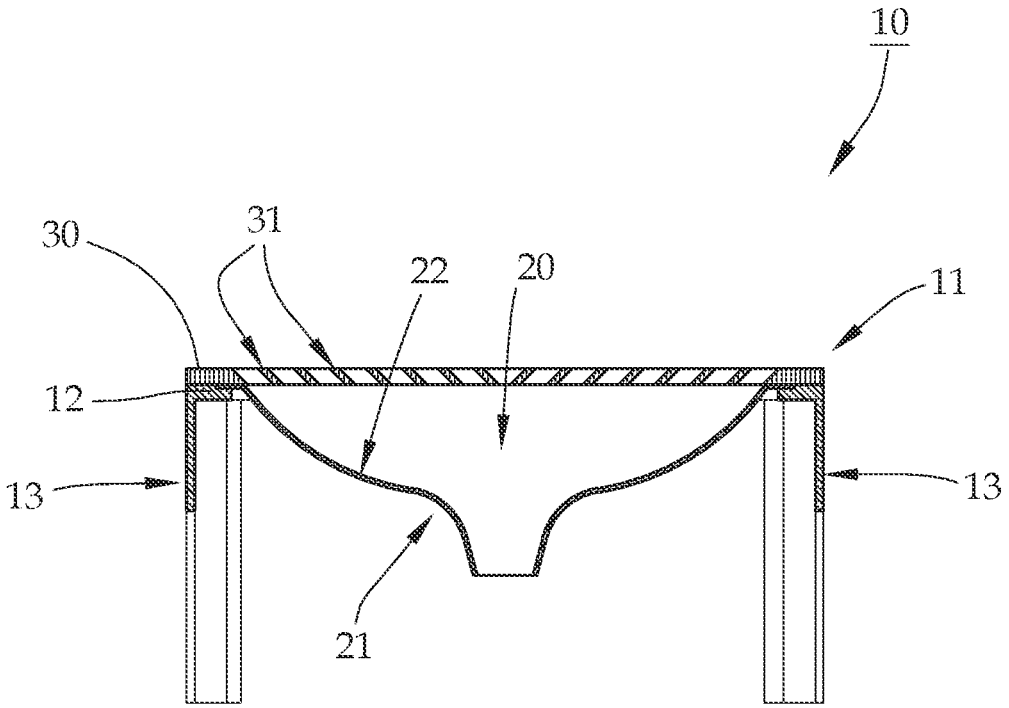
FIG. 3 illustrates a cross-sectional view of the drain seen in FIG. 4 along cut lines 3-3 with the pipe removed.
Figure 4:
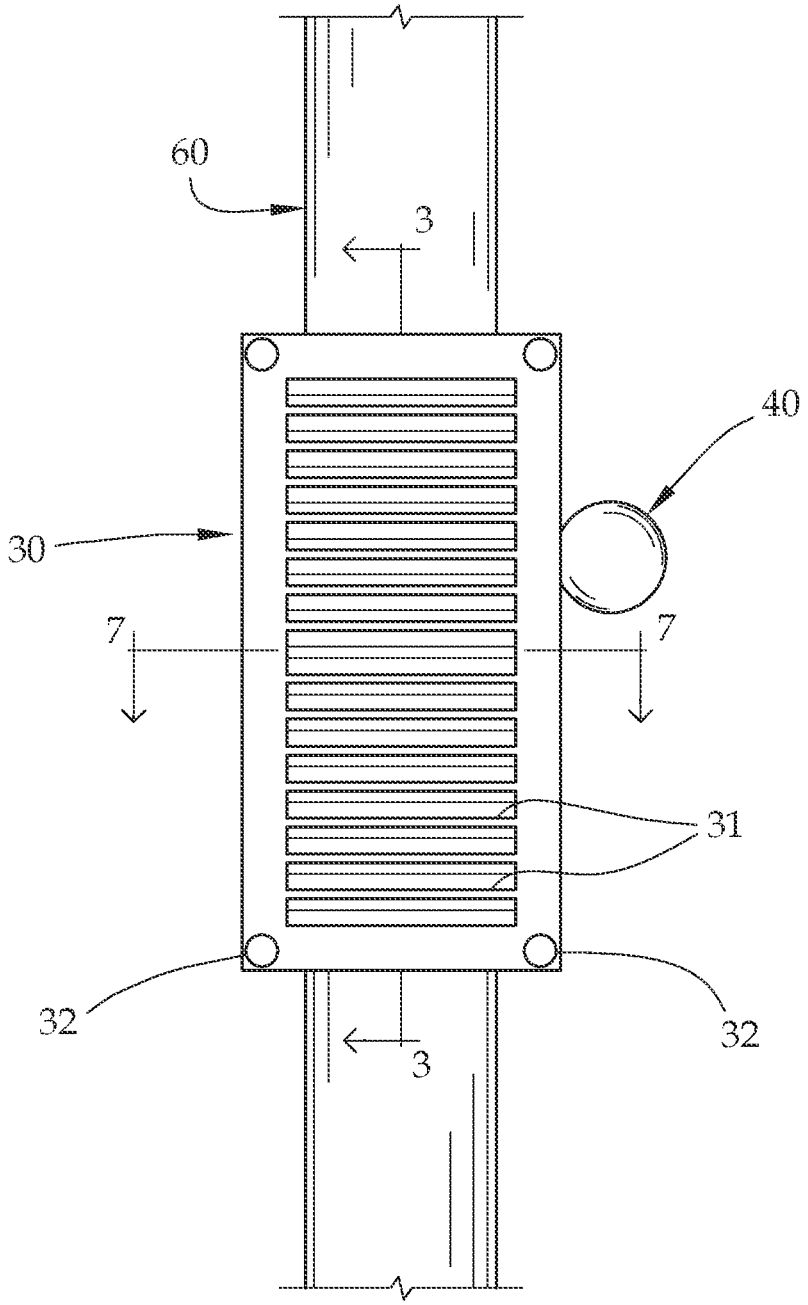
FIG. 4 illustrates a top plan view of the drain seen in FIG. 1.
Figure 8:
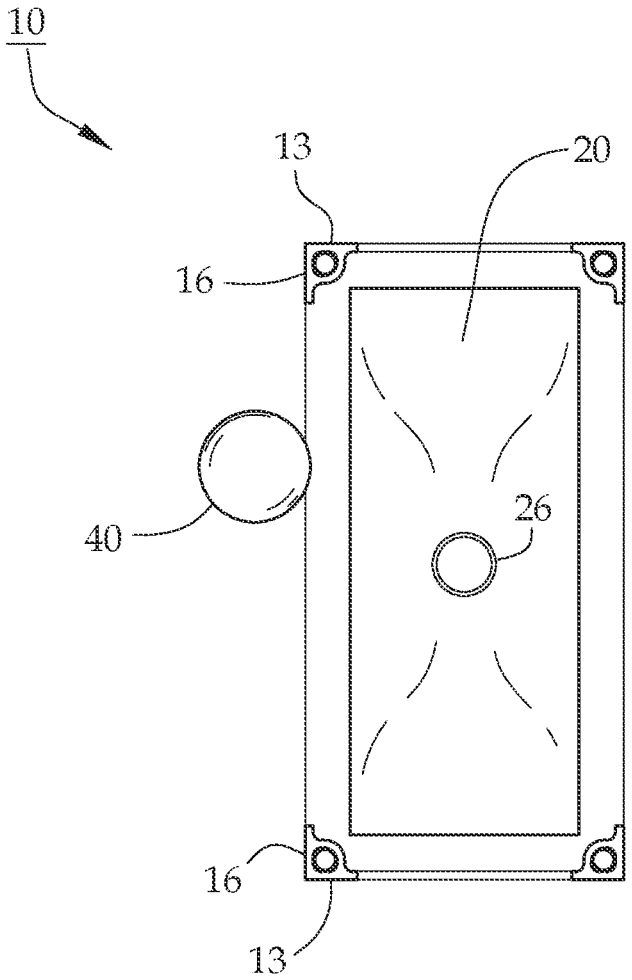
FIG. 8 illustrates a bottom view of the drain as seen in FIG. 2.

Drain 10 may additionally include one or more ballasts 40, such as seen in FIGS. 2 and 8. The ballast 40 is preferably placed on, connected to, affixed to, or otherwise releasably attached to any portion of the drain 10. The ballast 40 prevents displacement of first conduit 20 from the opening 61 in the second conduit 60 and thereby helps maintain fluid communication between the first conduit 20 and the second conduit 60.

As would be understood drain 10 while shown in a rectangular shape could likewise be formed having a square, circular, or other shape and further may be formed as a single, uniform piece or in one or more pieces and affixed together by conventional means. As further understood drain 10 and its components could be formed from various materials including but not limited to copper, iron, steel, and more preferably from conventional plastics such as polyvinyl chloride (PVC) or acrylonitrile butadiene styrene (ABS) for durability, improved manufacturing, and cost effectiveness. As seen in FIGS. 3, 5, 6, and 7, in one or more embodiments, the face 12 defines a ledge 17 and the first conduit 20 includes a flange 27 positioned proximate to upper end 23. The ledge 17 is configured to extend inward toward a center of the face 12. The flange 27 is configured to extend outward away from a center of the upper end 23. The flange 27 of the first conduit 20 is configured to rest on the ledge 17.

A method of using drain 10 comprises one or more of the steps of forming an opening 61 into a second conduit 60 and thereafter applying the stand 11 and inserting the lower end 25 of the first conduit 20 into the opening 61 formed in the second conduit 60. The method may further comprise affixing one or more fasteners 50 or 51 to the stand 11, applying a ballast 40 to the stand 11, and applying a drain cover 30 to the face 12 of the stand 11. In the preferred embodiment, the method further comprises affixing one or more fasteners 50 or 51 to the drain cover 30 and the stand 11. Affixing the drain cover 30 to the stand 11 ideally prevents debris from entering the first conduit 20 and second conduit 60. In the preferred embodiment, the method further comprises applying a ballast 40 to the stand 11.

Although only some embodiments are described herein, many alternative embodiments, modifications, and variations will be apparent to those skilled in the art. Accordingly, the written description intends to embrace all such alternatives, modifications, and variations as fall within its spirit and broad scope. The illustrations and examples provided herein are for explanatory purposes and are not intended to limit the scope of the appended claims.

I claim:

1. A drain comprising:

a stand (11) having an upper opening formed by a face (12) with an inwardly extending ledge (17) surrounding the upper opening, and at least one side (13);

a funnel-shaped first conduit (20), extending through the upper opening, the funnel-shaped first conduit (20) defining an interior surface and an exterior surface, the funnel-shaped first conduit (20) having an upper end (23) with an outwardly extending flange (27) and defining an inlet (24), and an outlet (26) at a lower end (25) in fluid communication with each other, the outwardly extending flange (27) being supported by the inwardly extending ledge (17);

a fluid permeable drain cover (30) capable of preventing solids above a certain size from entering the funnel-shaped first conduit (20), rests on top of the face (12) of the stand (11); and a second horizontal conduit (60) having a circular opening (61) formed through a sidewall, the at least one side (13) having an opening (15) that is sized and shaped to conformingly engage the exterior contour of the second horizontal conduit (60), and the lower end (25) of the funnel-shaped first conduit (20) being sized and shaped to be inserted into the circular opening (61).

2. The drain of claim 1, further comprising a weighted ballast (40), to prevent displacement of the lower end (26) of the funnel-shaped first conduit (20) from the circular opening (61) of the second horizontal conduit (60).

3. The drain of claim 2, further comprising a plurality of weighted ballasts (40).

4. The drain of claim 1, wherein the fluid permeable drain cover (30) comprises a plurality of slats (31).

5. The drain of claim 4, wherein the plurality of slats (31) comprises at least two slats arranged in series.

6. The drain of claim 1, further comprising one or more stand hole(s) (14) defined by the face (12) of the stand (11); and one or more drain cover hole(s) (32) defined by the fluid permeable drain cover (30).

7. The drain of claim 6, wherein the one or more drain cover holes (32) and the one or more stand holes (14) are sized and shaped to accept a fastener (50);

the fastener (50) is inserted through associated ones of the one or more drain cover holes (32) and the one or more stand holes (14); and wherein tightening the fastener (50) frictionally attaches the fluid permeable drain cover (30) to the face (12) of the stand (11).

8. The drain of claim 6, wherein the one or more drain cover holes (32) and the one or more stand holes (14) receive a stake (51); wherein the insertion of the stake (51) through associated ones of the one or more drain cover holes (32) and the one or more stand holes (14) frictionally attaches the fluid permeable drain cover (30) to the face (12) of the stand (11).

9. The drain of claim 1, wherein the opening (15) is circular.

10. The drain of claim 1, wherein the stand (11) comprises at least one additional side (13) having an opening (15) that is sized and shaped to conformingly engage the exterior contour of the second horizontal conduit (60), the at least one additional side (13) opposing the at least one side (13), forming at least two sides.

11. The drain of claim 10, where the openings (15) are circular and defined by an edge of the sides (13).

12. The drain of claim 1, wherein the outlet (26) and lower end (25) are circular in shape.

13. The drain of claim 1, wherein the upper end (23) and the inlet (24) are rectangular in shape.

14. A method of draining a surface comprising:

installing the drain of claim 1;

allowing liquid to drain into the second horizontal conduit (60) through the funnel-shaped first conduit (20).

15. The method of claim 14 wherein the step of installing includes affixing one or more fasteners to the stand.

16. The method of claim 14 wherein the step of installing includes applying a ballast to the stand.

17. The method of claim 14 wherein the step of installing includes applying a drain cover to the face of the stand.

18. The method of claim 17 wherein the step of installing includes affixing one or more fasteners to the drain cover and stand.

19. The method of claim 18 wherein the step of installing includes applying a ballast to the stand.

* * * * *